United States Patent [19]

Tschopp

[11] 4,110,179

[45] Aug. 29, 1978

[54] PROCESS AND DEVICE FOR THE PRODUCTION OF ALUMINIUM BY THE ELECTROLYSIS OF A MOLTEN CHARGE

[75] Inventor: Theodor Tschopp, Zollikon, Switzerland

[73] Assignee: Swiss Aluminium Ltd., Chippis, Switzerland

[21] Appl. No.: 791,973

[22] Filed: Apr. 28, 1977

[30] Foreign Application Priority Data

May 13, 1976 [CH] Switzerland ..... 6015/76

[51] Int. Cl.[2] ..... C25C 3/08; C25C 3/06

[52] U.S. Cl. ..... 204/67; 204/243 R

[58] Field of Search ..... 204/67, 243 R

[56] References Cited

U.S. PATENT DOCUMENTS

| | | | |
|---|---|---|---|
| 2,786,024 | 3/1957 | Wleugel | 204/243 R |
| 2,824,057 | 2/1958 | Thayer | 204/67 |
| 3,960,696 | 6/1976 | Witner | 204/243 R |

*Primary Examiner*—John H. Mack
*Assistant Examiner*—H. A. Feeley
*Attorney, Agent, or Firm*—Robert H. Bachman

[57] ABSTRACT

The magnitude of the horizontal components of electrical current flowing through the aluminium on the cathode blocks of an electrolytic reduction cell are reduced by ensuring that the current transmitted decreases towards the edge of the electrolytic cell. This is achieved by making the contact resistance between the carbon lining and the cathode bars embedded in the carbon cathode blocks increase towards the edge of the cell. The result is that the tendency for the melt to bulge upwards and the stirring action in the electrolyte are considerably reduced.

15 Claims, 6 Drawing Figures

Figure 1:
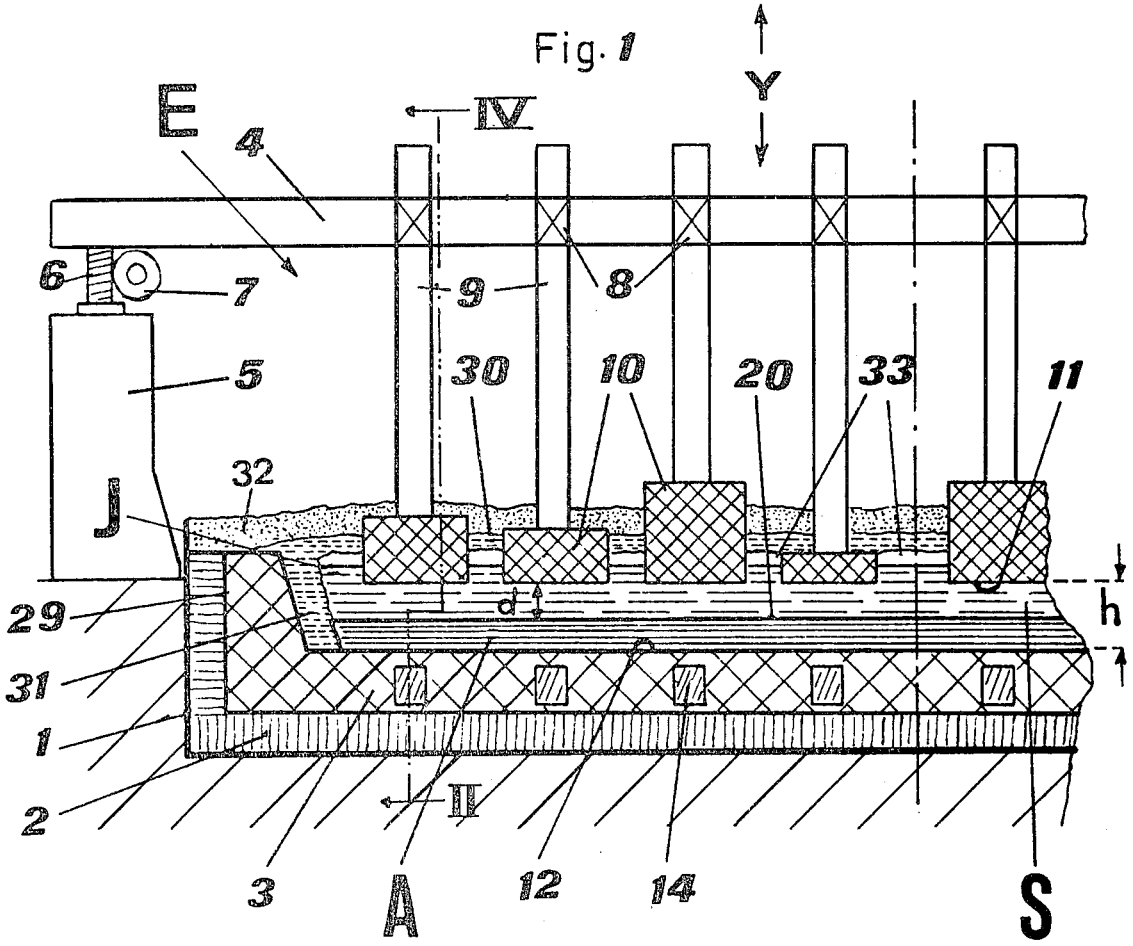

9
50
49
10
S
A
2
29
48
14
49
31
50

PROCESS AND DEVICE FOR THE PRODUCTION OF ALUMINIUM BY THE ELECTROLYSIS OF A MOLTEN CHARGE

The invention concerns a process and device for the production of aluminium via electrolysis using an electrolytic cell which has anodes dipping into a molten electrolyte under which, opposite the anodes and at a distance from them, there are cathode bars embedded in the carbon lining of the cell in which the liquid aluminium, produced in the process and lying on the carbon blocks under the anodes serves as the cathode.

In the electrolytic production of aluminium from aluminium oxide ($Al_2O_3$) the aluminium oxide is usually dissolved in a fluoride melt which, for the main part, consists of cryolite ($Na_3AlF_6$). The aluminium, which separates out at the cathode, collects on the carbon blocks of the cell under the fluoride melt; the surface of this liquid aluminium then acts as the cathode. Immersed into the fluoride melt are the anodes at which the oxygen ions from the aluminium oxide form oxygen which, in the conventional process using carbon anodes, combines with the carbon to form CO and $CO_2$.

The electrical conductivity of the fluoride melt is so poor compared with that of the liquid aluminium that the electrical current flowing in the electrolyte from the anodes in the direction of the cathodic carbon lining flows approximately vertically through the fluoride melt (i.e. the current density in the vertical direction in the electrolyte is in general uniform everywhere). This however does not apply to the carbon lining and the underlying cathode bars, which can for example be in the form of iron bars. The carbon lining of the floor, cathode bars and the contact resistance between these have different electrical properties with the result that the carbon lining transmits relatively more current at the edge of the cell than in the middle or centre of the cell. The current drawn from the bottom of the liquid aluminium is therefore still non-uniform even if there is a completely uniform supply of current to the upper surface of the liquid aluminium. The components of current density which are essentially horizontal and directed outwards in the liquid aluminium are very harmful. Together with the unavoidable, magnetic induction forces in the liquid aluminium, they produce forces which differ greatly from those in the electrolyte, causing the liquid aluminium to bulge upwards and producing a stirring effect.

With this in mind the inventor set himself the task of eliminating the outward, horizontal components of electrical current flowing in the liquid aluminium and, in a process of the kind described at the beginning, achieving a uniform current density in the vertical direction also in the liquid aluminium. This object is achieved by way of the invention in that the electrical conductivity between the melt (and/or the cathode) and the cathode bars is reduced from the centre of the cell to the edge of the cell in such a way that the same current density per unit area flows through the electrolytically deposited aluminium to the cathode bars over approximately the whole width of the cell. The electrical contact between the cathode bars and the conventional, surrounding carbon lining should be made to decrease from the centre of the cell to its edge in such a way that the same current per unit area of carbon lining is transmitted from the deposited aluminium to the carbon lining over the whole width of the cell. This process is made possible by a device by means of which the electrical contact between the carbon lining and the cathode bars decreases from the centre of the cell to its edge and the contact resistance increases in the same direction.

Thanks to this measure the forces in the liquid aluminium and in the electrolyte are equalised with the result that the above mentioned bulging and stirring action in the liquid aluminium is either markedly reduced or even eliminated. This is achieved by eliminating the outward, horizontal components of electrical current in the liquid aluminium.

In accordance with another feature of the invention the electrical current flowing may be decreased stepwise from the centre of the electrolytic cell to the edge of the cell, with the length of the steps or regions providing electrical contact between the carbon lining and the cathode bars decreasing in the same direction, and the width of the spaces between these regions of electrical contact increasing.

It is also within the scope of the invention to make the amount of electrical power transmitted decrease continuously from the centre of the cell to the edge of the cell by filling the space between the carbon lining and the conductor bars with a conducting medium, preferably by pouring cast iron into the space, and such that the said space is filled to a decreasing extent towards the edge of the cell.

The carbon lining, which is usefully made up of individual prebaked carbon blocks, is connected discontinuously to the iron cathode or collector bars by a compressible mass which is a good electrical conductor or by cast iron, with the result that the areas where there is less contact produce an increase in the contact resistance towards the edge of the cell. The electrical current drawn by the carbon lining increases therefore towards the centre of the cell and decreases towards the edge of the cell, and can even decrease to zero current. By predetermining the size of the contact resistance the electrical current can be made flow vertically through the liquid aluminium.

The prevention of horizontal, outward oriented components of electrical current in the liquid aluminium diminishes the amount of electrolytically produced aluminium which is re-oxidised by the anode gases in that, as explained above, the bulging and/or stirring of the liquid aluminium is considerably reduced or eliminated. Furthermore, since the increase in contact resistance also leads to a greater barrier to heat flow between the carbon lining and the cathode bars, the heat losses through the iron cathode bars are also reduced.

Further advantages, features and details of the invention are revealed in the following description of preferred embodiments and with the aid of the drawings viz., FIG. 1: A lengthwise section through a part of a conventional aluminium reduction cell.

Figure 2:
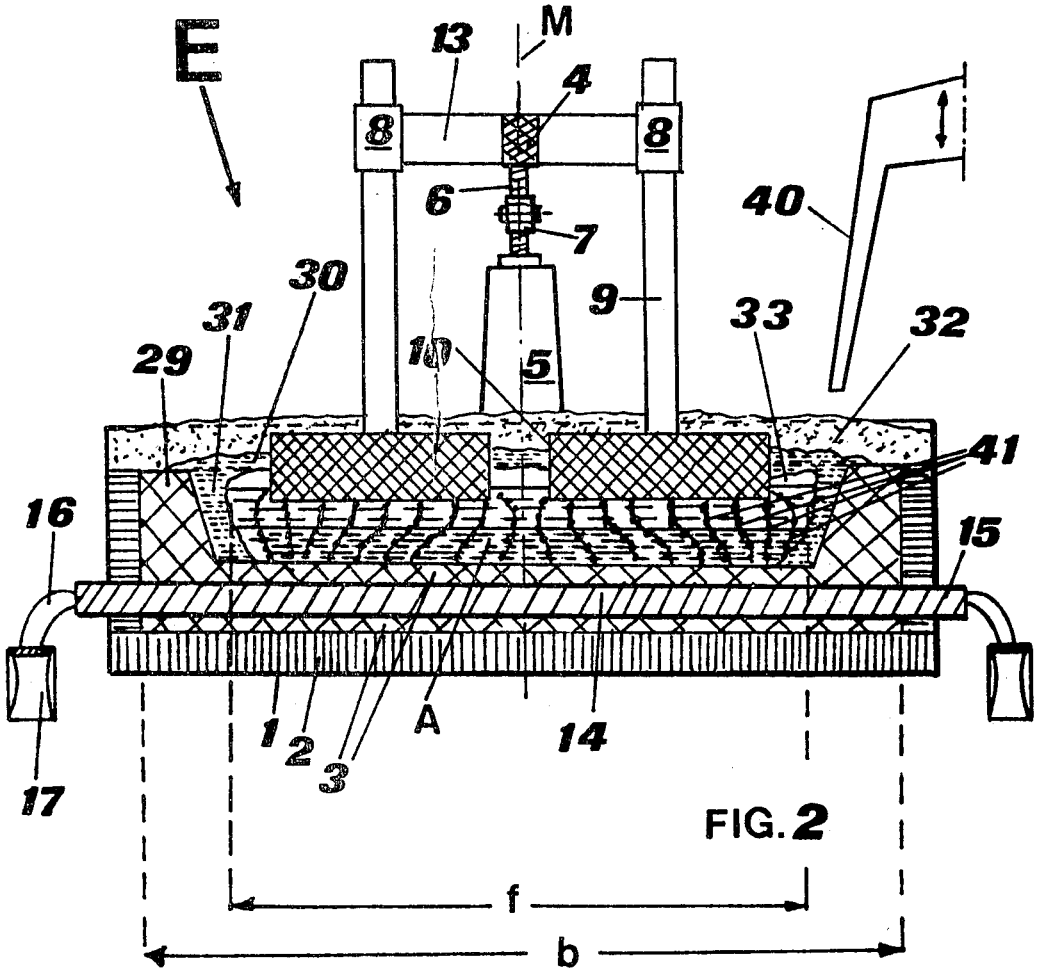

FIG. 2: A section through the view shown in FIG. 1 along the line II–IV.

Figure 3:
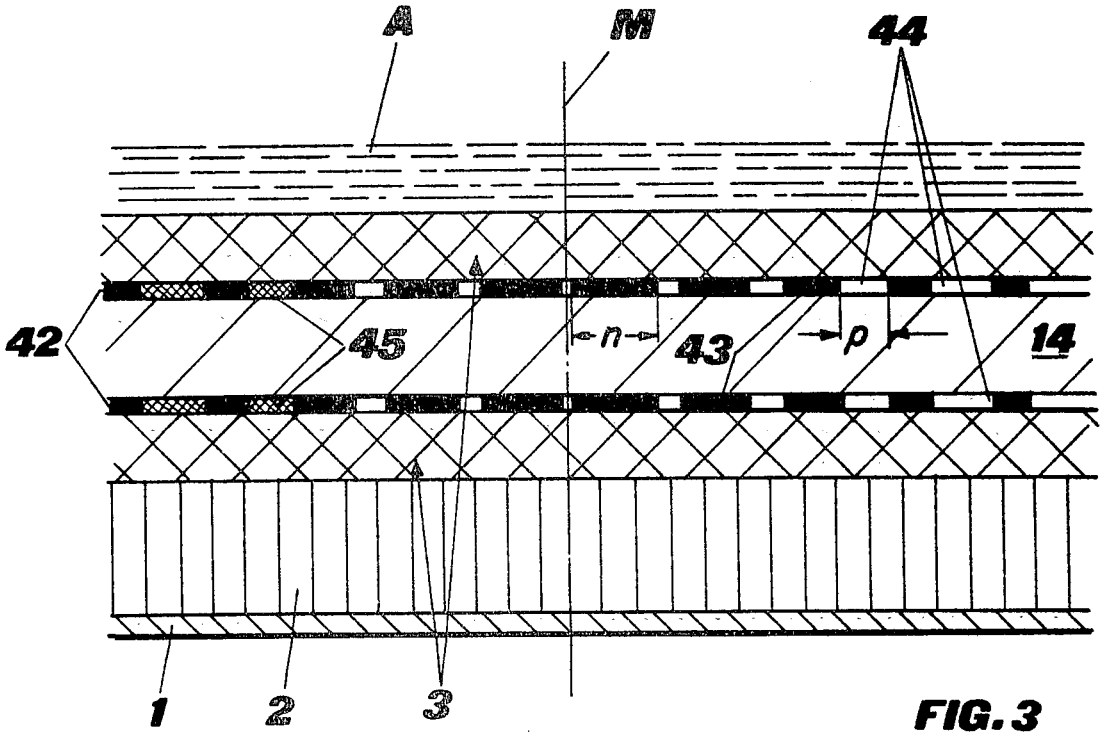

FIG. 3: An enlargement of part of the section shown in FIG. 2.

Figure 4:
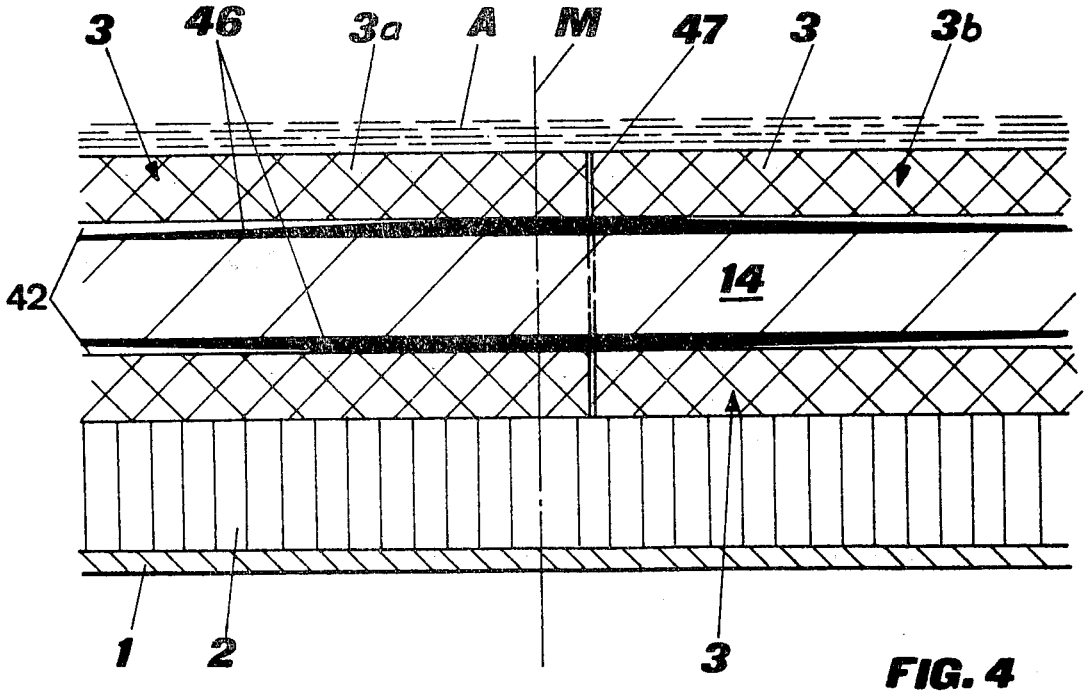

FIG. 4: An enlargement of a section corresponding to FIG. 3 but showing another exemplified embodiment of the invention.

Figure 5:
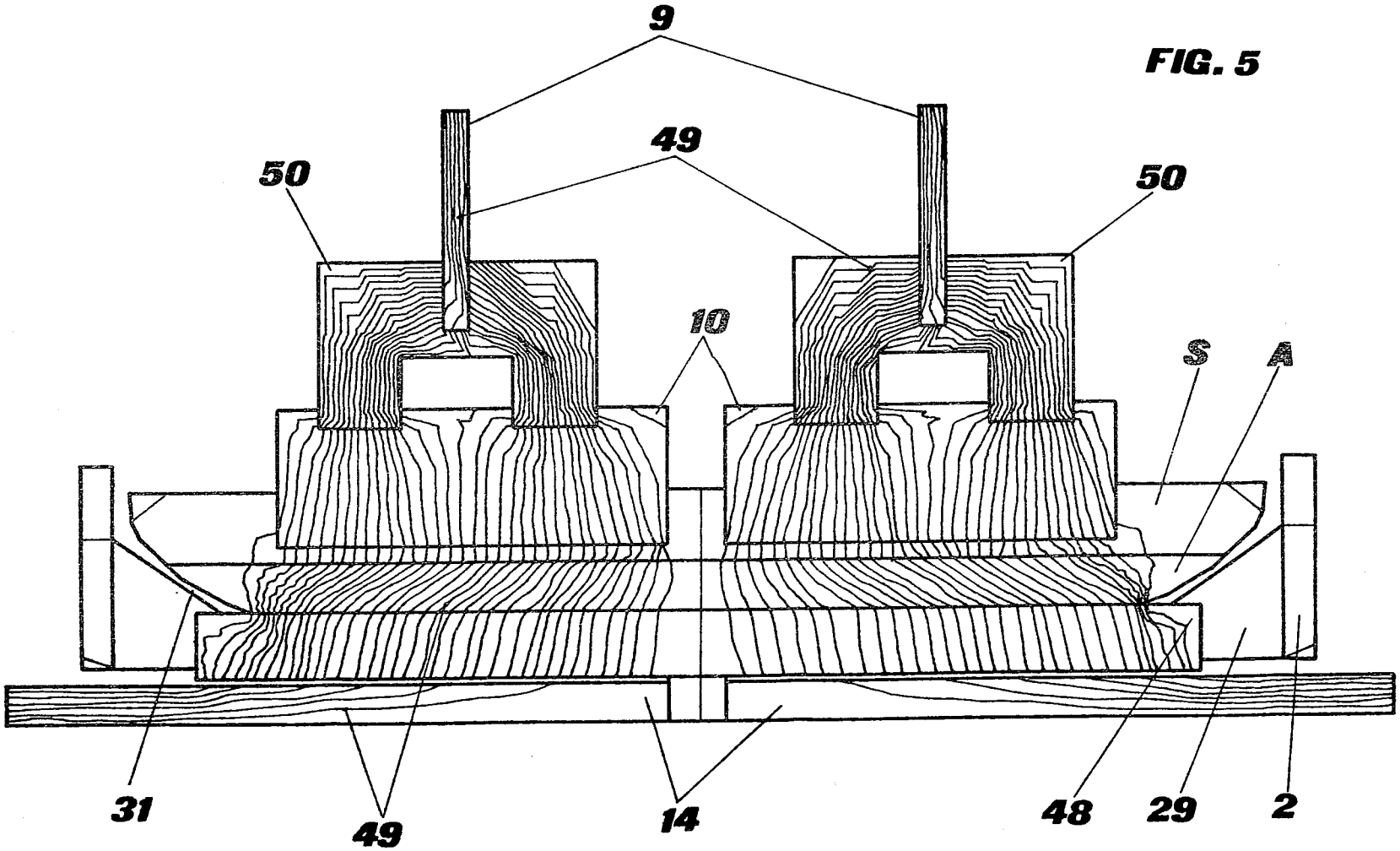

FIG. 5: The paths taken by the electric current in an EM-14 electrolytic cell fitted with conventional cathode bars.

Figure 6:
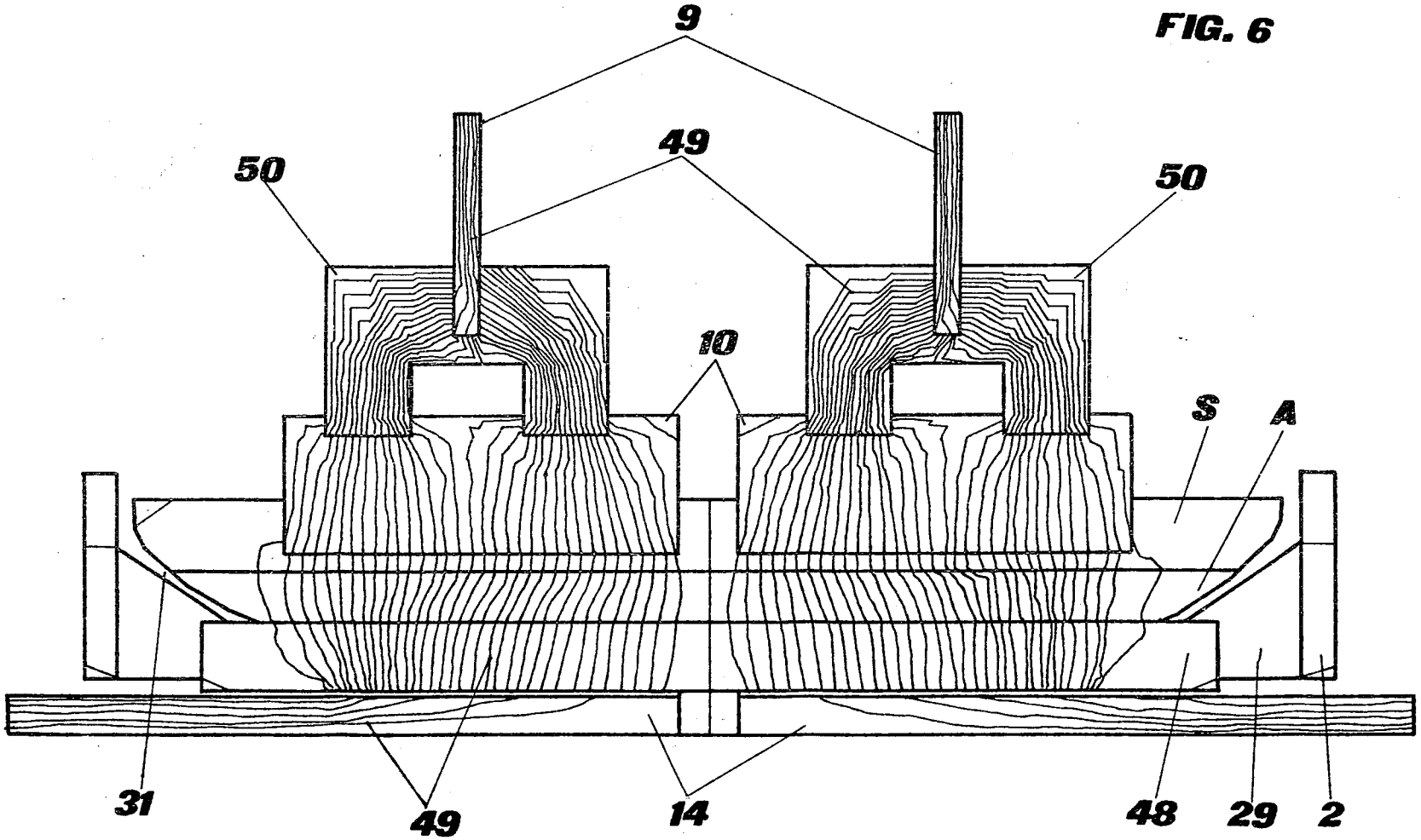

FIG. 6: The paths taken by the electric current in an EM-14 electrolytic cell in which the contact resistance between the carbon floor and the cathode bars increases towards the edge of the cell.

Above a steel container 1 lined with a thermally insulating layer 2 and carbon lining 3, and running in the lengthwise direction of the container 1 there are provided anode beams 4 which rest on spindles 6 on columns 5 and which can be raised or lowered in the dirctions "Y" by means of the cogged wheels 7 engaging in the spindle or spindles 6.

Anode rods 9, which hang approximately vertical, are suspended from the anode beams to which they are secured by clamps 8 and have at their lower ends which point towards the container 1, anodes 10 made of amorphous carbon. The carbon anodes can be raised or lowered by means of the anode rods 9 in the clamps 8 to change or adjust the distance between the under side 11 of the anode and the inner surface 12 of the carbon lining 3.

As illustrated in FIG. 2, in a steel container 1 with only one anode beam 4 spanning the middle vertical position M and supporting the transverse beam 13 which supports the conductor rods 9, the carbon lining 3 is penetrated across its whole width *b* by steel collector bars 14 the outward projecting ends 15 of which are connected via flexible conductors 16 to the busbars 17 running along the side of the cell.

In the space J inside the steel container 1 with its carbon lining 3, there is provided, a fluoride melt S consisting mainly of cryolite ($Na_3AlF_6$) which serves as the electrolyte for the production of aluminium by the electrolytic decomposition of aluminium oxide.

The cathodically deposited aluminium A collects on the carbon lining 3; the surface 20 of this aluminium A then acts as the cathode in the electrolytic process, the anodes 10 being suspended above this surface 20 and at a distance "*d*" from it.

Direct current is supplied via the anode beam or beams 4 and the anode rods 9 to the anodes 10, then through the electrolyte S, the liquid aluminium A and the carbon lining 3 to the cathode bars 14. The current then flows from the cathode bars 14 of the above mentioned cell E the anode beam of the next cell in series (not shown here). This pattern can be repeated as desired in accordance with the number of cells in the series.

The electrolyte S is covered with a crust 30 of solidified fluoride melt, similarly a side freeze 31 forms at the sides 29 of the carbon lining. This side freeze 31 determines the horizontal expansion "*f*" of the bath of liquid aluminium A and electrolyte S.

On the top crust 30 there is a layer 32 of aluminium oxide and between this crust 30 and the fluoride melt S there is a space 33.

The distance "*d*" from the bottom face 11 of the anode to the aluminium surface 20, also called interpolar distance, can be changed by raising or lowering the anode beam 4 in the direction "Y" using the jacking device 6 – 7; this takes place either simultaneously for all anodes 10 or by means of the clamps 8 for each anode rod 9 individually.

As a result of attack by the oxygen released during the electrolytic process, the anodes 10 are consumed at their bottom face 11 by 15–20 mm per day, the extent depending on the type of cell. Simultaneously, the surface 20 of the liquid aluminium A in the cell E rises by 15–20 mm in the same interval of time. After the anode 10 has been consumed, it is replaced by a new anode 10.

In practice a cell E is operated in such a way that after only a few days there are signs of various degrees of attack to the individual anodes 10. The anodes 10 must therefore be changed at different times stretching over a period of several weeks. FIG. 1 shows that in a cell E there are anodes 10 which have been in service for different lengths of time.

In the course of electrolysis the aluminium oxide content of the electrolyte decreases. At a lower concentration limit of 1–2 % $Al_2O_3$ in the electrolyte S, the so called anode effect occurs whereby the voltage increases suddenly from the normal value of 4 to 4.5 V to 30 V and more. At this point of time, at the latest, the top crust 30 must be broken and the $Al_2O_3$ content increased by the addition of fresh aluminium oxide 32.

Usually, in the normal operation of the cell E, aluminium oxide is added at regular intervals, even if the above mentioned anode effect has not occurred. In addition, each time the anode effect occurs, as described above, the crust 30 must be broken and the aluminium oxide concentration raised by addition of $Al_2O_3$. In practice therefore the anode effect is always associated with extra cell supervision. The electrolytically deposited aluminium which collects on the carbon lining 3 of the cell E is normally taken out of the cell E once each day using conventional equipment for example by means of a suction pipe 40.

The electrical conductivity of the fluoride melt S is so low compared with that of the liquid aluminium that the electric current leaving the lower face 11 of the anode 10 flows through the fluoride melt S in an approximately vertical direction. If marginal effects are ignored then the vertical current density in the electrolyte S is consequently the same everywhere.

The combination of the carbon lining 3 with the cathode bars 14 inside, and the contact resistance between these components, brings together elements which have different properties. Because of the difference in electrical properties, the carbon lining 3, which takes in the electric current from the liquid aluminium A, draws more power from the edge of the cell than from the middle M of the cell. If the upper surface 20 of the aluminium A receives a uniform supply of power and the withdrawal of power at the inner surface 12 of the carbon lining 3 is non-uniform, then a current must flow in the horizontal direction in the liquid aluminium to compensate for the deflection in the lower paths shown in FIG. 2. The current then leaves the anode 10 in an approxiately vertical direction and flows outwards in the liquid aluminium A i.e. towards the wall of the steel container 1.

The horizontal, outward oriented components of electrical current flowing in the liquid aluminium A are very harmful. They combine with the magnetic forces which are induced by the neighbouring supply and are always present in the liquid aluminium and generate forces which are very different from those in the electrolyte S. The results of these differences in force are that the liquid aluminium bulges upward and/or is agitated due to a stirring action. Both effects impair the functioning of the cell considerably since they cause the aluminium A which has already been deposited to be brought near the anodes 10, where it is oxidised to $Al_2O_3$ by the itinerant anode gases ($CO_2$) with a consequent loss in production.

This problem can be avoided as shown in FIGS. 3 and 4 by means of electrically conductive layers 42 and 46 which are provided between the carbon lining 3 and the cathode bars 14. The parts 43 of the layer 42 are of different length "*n*" in the direction transverse to the long axis of the cell, decreasing in length "*n*" towards the side wall of the steel container 1. The width "*p*" of the space 44 between the cast or compressed parts 43 increases accordingly in the same direction. The parts of the cathode bars 14 adjacent to these space 44 can be insulated from the carbon lining 3 by badly or non-conducting material 45. This insulation can be omitted in the middle of the cell and/or be completely insulating at the edge of the cell.

If the lengths 43 of cast or rammed-in, electrically conductive material are shorter towards the outside or if, as shown in FIG. 4, the amount of cast iron or electrically conductive compressed mass 46 between the cathode bars 14 and the carbon lining 3 decreases in the same direction, then the contact between the cathode bars 14 and the carbon lining 3 becomes poorer towards the edge of the cell. The accompanying increase in contact resistance towards the outside is determined according to the electrical grid calculation such that the amount of current drawn from the liquid aluminium A by the carbon lining 3 is the same everywhere in the cell E.

FIG. 4 also shows that the carbon lining 3 is made up of individual blocks 3*a* and 3*b* which fit together with negligably small gaps 47 between them. The cathode bar 14 is shown here as being in one piece although, as FIGS. 5 and 6 show, it can also be in two parts.

Whilst in FIG. 5 the cathode bars are incorporated in the carbon floor 48 in the normal manner, in FIG. 6 the electrical contact between the carbon floor 48 and the cathode bars 14 becomes worse towards the edges of the cell. The electrical current, represented by the flux lines 49, flows through the anode rods 9, the carrier plates 50 and the body 10 of the anodes, the molten electrolyte S, the liquid aluminium A and the carbon floor 48 into the cathode bars 14 which conducts away the current, still represented by the flux lines 49.

A data processing program, prepared for the EM 14 cell represented schematically here, enables the paths of the flux lines 49 to be plotted out. In FIG. 5 the flux lines in the liquid aluminium A are oriented strongly outwards i.e. towards the edge of the electrolytic cell, agitating the liquid aluminium and causing it to bulge upwards.

In FIG. 6 on the other hand, where the electrical conductivity is reduced (possibly even to zero) towards the edge of the cell, for example as illustrated in the exemplified embodiment shown in FIGS. 3 or 4, then the lines of flux run approximately vertically through the liquid aluminium. Where the passage of electrical current between a carbon cathode block and cathode bar of conductive compressed mass should be prevented, the space between the block and the bar is filled with insulating material e.g. asbestos cord instead of cast iron. This way the above mentioned bulging and stirring action in the liquid aluminium are either markedly reduced or even eliminated.

what is claimed is:

1. In a process for the production of aluminum from an aluminum compound by electrolysis in an electrolytic cell, the cell having a center, at least two edges, a predetermined width and a containing molten electrolyte, and including a plurality of anodes immersed in the electrolyte, a carbon layer lining the cell, a plurality of cathode bars embedded in the carbon lining, and disposed at a predetermined distance from the anodes, the aluminum compound being disposed between the anodes and the cathodes, the steps comprising:

passing a current through the cell, precipitating aluminum from the aluminum compound, the aluminum serving as a cathode, and reducing progressively the area of electrical contact between the cathode bars and the carbon lining from the center of the cell to the edges thereof, so that the carbon lining draws operatively substantially the same current per unit area from the precipitated aluminum over approximately the whole width of the cell.

2. In a process according to claim 1, including a conductive layer disposed between the cathode bars and the carbon lining, and further comprising the steps of reducing the area of electrical contact of portions of said layer between the cathode bars and the carbon lining in dependence of the distance of a corresponding portion of said layer from said center, and the proximity of the corresponding portion to one of said edges.

3. In a process according to claim 2, further comprising the steps of forming a plurality of openings in said layer of predetermined area, the areas of said openings increasing in dependence of the distance of a corresponding opening from said center, and the proximity of the corresponding opening to the one of said edges.

4. A process according to claim 3, wherein each of said areas has a predetermined length in a direction extending from the center of the cell to one of the edges, said lengths increasing in dependence of the distance of a corresponding area from said center, and the proximity of the corresponding area to the one of the edges.

5. In a process according to claim 2, wherein said layer has a predetermined width, and further comprising the steps of reducing the width of said layer in dependence of the distance from said center and the proximity to the one of said edges.

6. In a process according to claim 2, further comprising the steps of pouring cast iron into the cell so as to form said conductive layer.

7. An apparatus for the precipitation of aluminum from an aluminum compound, comprising in combination:

an electrolytic cell, having a center, at least two edges and a predetermined width, said cell containing a molten electrolyte, a current being passable through said cell, a carbon layer lining the cell, a plurality of anodes immersed in the electrolyte, and a plurality of cathode bars embedded in the carbon lining, and disposed at a predetermined distance from the anodes, the aluminum compound being disposed between the anodes and the cathodes, and the aluminum being operatively separable in said cell from the aluminum compound, the separated aluminum serving as a cathode, there existing predetermined areas of contact between said cathode bars and said carbon lining from the center of said cell to the edges thereof adjusted so that the carbon lining draws operatively substantially the same current per unit area from the separated aluminum over approximately the whole width of said cell.

8. An apparatus according to claim 7, further comprising a conductive layer disposed between said carbon lining and said cathode bars, said conductive layer providing said predetermined areas of contact between said cathode bars and said carbon lining.

9. An apparatus according to claim 8, wherein said conductive layer is formed with a plurality of openings of respective predetermined areas, whereby a plurality of conductive regions of respective predetermined lengths are created between the center of said cell and at least one of the edges of said cell, each of the lengths extending in a direction from the center of said cell to the one of the edges of said cell.

10. An apparatus according to claim 9, wherein the lengths of said conductive regions decrease in dependence of the distance of a corresponding conductive region from the center of said cell towards the one of said edges.

11. An apparatus according to claim 9, wherein the predetermined areas of said openings decrease in dependence of the distance of a corresponding opening from the center of said cell towards at least one of said edges.

12. An apparatus according to claim 8, wherein said conductive layer is selectively compressible to provide said predetermined areas of contact.

13. An apparatus according to claim 8, wherein said conductive layer comprises poured cast iron.

14. An apparatus according to claim 7, wherein said carbon lining includes a plurality of prebaked blocks, at least some of said blocks being individually connected between a corresponding one of said anodes and a corresponding one of said cathode bars.

15. An apparatus according to claim 7, wherein said conductive layer has a predetermined width decreasing from the center of said cell to at least one of the edges of said cell.

* * * * *